US005406875A

United States Patent [19]

Tamai et al.

[11] Patent Number: 5,406,875

[45] Date of Patent: Apr. 18, 1995

[54] KEYBOARD APPARATUS FOR ELECTRONIC MUSICAL INSTRUMENT

[75] Inventors: Yutaka Tamai; Yoshiaki Shimoda; Kazuhiro Tsukamoto, all of Hamamatsu, Japan

[73] Assignee: Kabushiki Kaisha Kawai Gakki Seisakusho, Hamamatsu, Japan

[21] Appl. No.: 20,307

[22] Filed: Feb. 19, 1993

[30] Foreign Application Priority Data

| | | | |
|---|---|---|---|
| Mar. 10, 1992 | [JP] | Japan | 4-11862 U |
| Mar. 10, 1992 | [JP] | Japan | 4-11863 U |
| Mar. 10, 1992 | [JP] | Japan | 4-11864 U |
| Mar. 10, 1992 | [JP] | Japan | 4-11865 U |
| Mar. 10, 1992 | [JP] | Japan | 4-11866 U |
| Mar. 10, 1992 | [JP] | Japan | 4-11868 U |

[51] Int. Cl.[6] ..... G10C 3/12

[52] U.S. Cl. ..... 84/433; 84/719

[58] Field of Search ..... 84/433, 434, 719, 720, 84/DIG. 7, 435, 436, 221

[56] References Cited

U.S. PATENT DOCUMENTS 5,079,985 1/1992 Yamaguchi et al. ..... 84/719
5,254,804 10/1993 Tamaki et al. ..... 84/DIG. 7 X

FOREIGN PATENT DOCUMENTS 2-149990 12/1990 Japan .
2-149991 12/1990 Japan .
2-149992 12/1990 Japan .
2-149993 12/1990 Japan .
2-149994 12/1990 Japan .
2-149998 12/1990 Japan .

*Primary Examiner*—Michael L. Gellner
*Assistant Examiner*—Patrick J. Stanzione
*Attorney, Agent, or Firm*—Armstrong, Westerman, Hattori, McLeland & Naughton

[57] ABSTRACT

A keyboard apparatus for an electronic musical instrument has a metallic keyboard chassis and a balance rail provided on the keyboard chassis. A plurality of pins are provided on the balance rail. The pins and the balance +*rail constitute fulcrums for swingably supporting white keys and black keys. The fulcrums for the black keys are disposed on the same line with, or in front of, the fulcrums for the white keys. Hammers are provided in a rear of the keys so as to be swingable by swinging of each of the respective keys. The hammers are disposed on the same axis of rotation, and a position for the black keys to operate to swing the respective hammers is located in front of a position for the white keys to operate to swing the respective hammers such that an angle of rotation of the respective hammers becomes substantially equal to each other. A stopper member for restricting the swinging movement of the keys or the hammers are provided in a rear upper portion of the keys. The metallic key board chassis is divided into a front chassis portion and a rear chassis portion, and the two are connected by metallic reinforcing beams.

2 Claims, 13 Drawing Sheets

KEYBOARD APPARATUS FOR ELECTRONIC MUSICAL INSTRUMENT

BACKGROUND OF THE INVENTION

The present invention relates to a keyboard apparatus for an electronic musical instrument such as an electronic piano, electronic organ, or the like.

The applicants of the present invention have proposed a keyboard apparatus in Japanese Published Unexamined Utility Model Registration Application Nos. 149990/1990 through 149994/1990 and 149998/1990, as shown in FIG. 1. The keyboard apparatus for an electronic musical instrument comprises a metallic keyboard chassis 1, a balance rail 2 which is mounted on the keyboard chassis 1, pins 3 which are provided on the balance rail 2. The balance rail 2 and each of the pins 3 constitute a fulcrum 7 for a black key 5 and a white key 6, respectively. The fulcrum for the black key 5 is arranged in the same row as, or in front of (i.e., to the side of a player), the fulcrum for the white key 6. In the rear of each key, there is provided a hammer 8 which is caused to swing by the swinging of each key. In the arrangement of this keyboard apparatus, a force of inertia is given by the hammer 8 when the key is operated. By positioning the fulcrum, on the balance rail 2, for the black key 5 in the same row as, or in front of, the fulcrum for the white key 6, it is possible to give a feeling of mass to the black key 5 which is shorter in length than the white key 6, with a result that the feeling of key-touching at the time of playing can be improved. In FIG. 1, showing the prior art, numeral 9 denotes a front rail, numeral 10 denotes a guide pin, numerals 11*a*, 11*b* denote means for restricting the downward movement of the keys 5, 6 and which are provided in a front portion of the keyboard chassis 1, numeral 12 denotes a sound generating switch which is operated by a switch pressing member 13, numeral 14 denotes a weight, numeral 15 denotes a supporting member for the hammers 8, and numeral 16 denotes a holder for the keys. Numeral 17 denotes a hammer upper limit stopper which is made up of a metallic rail or a cushion provided in a rear portion of the keys and below the hammers 8 via a bracket 21 in order to restrict the swinging of the hammers 8. Numeral 20 denotes an upper limit stopper for restricting the upward swinging of the keys 5, 6.

(In the above and following descriptions, members such as the key and the hammer are referred to in a singular form as well as in a plural form. The member described in a singular form, due partly to linguistic limitations or reasons, is to be understood to include a plural form where necessary.)

Further, another prior art arrangement is known, as shown in FIG. 2, in which there is provided, above the keys 18, a rail 17 which extends in the lateral direction, i.e., in the direction in which the keys 18 are arranged. A rear upper end portion of each key 18 is thus made to abut the rail 17 to directly restrict the movement of the keys 18. Furthermore, as shown in the prior art FIG. 3, in a rear upper portion of each key 18, there is swingably disposed the hammer 8 with a capstan pin 19. It is thus so arranged that the swinging movement of the hammer 8 is restricted by the rail 17 which extends in the lateral direction, i.e., in the direction in which the keys are arranged.

In an ordinary keyboard apparatus for an electronic musical instrument, there is known a prior art apparatus as shown in FIGS. 7 and 8 in which each key 31 which is provided on a key bed 30 so as to be swingable about a fulcrum 7 is fixed in the following manner. Namely, a shaft 32, which extends upwards through the key bed 30 above the keys 31, is pulled down by a lever 34 to fix it by a rail 33 provided on the shaft 32. The keyboard apparatus is thus prevented from being damaged by the movement of the keys 31 through vibrations and shocks during transportation or movement of the electronic keyboard apparatus.

In the keyboard apparatus it is general practice to set the swinging distances of the black key and the white key substantially equal to each other so that the feeling of operation (i.e., depression or touching) of the keys does not vary between the black key and the white key. In the above-described keyboard apparatus, the distance from the fulcrum for the black key to the hammer 8 and the distance from the fulcrum for the white key to the hammer 8 are substantially equal to each other. Or else, the former is longer than the latter. It follows that the hammer 8 for the black key swings at a larger angle than does the white key. As a result, there is a disadvantage in that the dynamic feeling of touching the key varies from the black key to the white key. Further, in an electronic musical instrument in which a touch-detecting device, i.e., a device for detecting the touching of the hammers, is provided in the hammer 8, there is another disadvantage in that the detected values may fluctuate because the angle of rotation of the hammer 8 varies from the black key to the white key even with the same strength of touching or depressing the key.

In the conventional keyboard apparatus for an electronic musical instrument shown in FIG. 1, the distance or length of the key from the fulcrum backwards is set to be equal for both the black key and the white key. Since the black key and the white key are depressed by the same stroke, the rear end of the black key whose distance from the fulcrum forwards is shorter than that of the white key is, as shown in FIG. 4, lifted higher than the rear end of the white key 6 by the difference or distance L. However, if the rail 17 is provided as described above, the movement of the rear end of the black key 5 will be restricted in the course of the stroke. Due to this restriction, there is a disadvantage in that a difference in the feeling of touching is generated between the black key 5 and the white key 6. Further, since the keys are made of wood, they are subject to deformation due to environmental changes. As a result, there is a disadvantage in that their movements are similarly subject to deviations or fluctuations. In the apparatus shown in FIG. 3, if the length of the capstan pin 19 is adjusted so that the hammer 8 for the black key 5, for example, can be moved to the same height as that of the hammer 8 for the white key 6, the foregoing problem may be solved. However, the capstan pin 19 is expensive and, since it is mounted inside the mechanism, its adjustment is difficult. Since such an adjustment work is difficult in the rear or in the lower portion of the keyboard apparatus due to wiring and other mechanisms, it is preferable to position the adjusting members in an upper portion of the keyboard apparatus.

In a construction, as shown in FIG. 1, in which the entire keys are mounted on a single piece of keyboard chassis 1, there is a disadvantage in that, when the keys are long, the keyboard chassis 1 also becomes long accordingly, with the result that it becomes large in weight and high in cost. As a solution to this problem, an attempt was made to divide the keyboard chassis into the front and rear portions to directly mount them on the key bed. However, there was a disadvantage in that the assembling accuracy was poor with a small mechanical strength.

Furthermore, the applicants also earlier proposed an apparatus which has substantially the same construction as shown in FIG. 1 except that the position for mounting the hammer 8, which is provided to give the swinging of the key a force of inertia, is set to be a rear upper portion of the key, thereby minimizing the length, in the longitudinal direction of the keys, of the keyboard apparatus and facilitating the assembling of the hammer 8. In the resultant arrangement as shown in FIGS. 5 and 6, shafts 22, 22 of a substantially oval cross section are provided on both side surfaces of the hammer 8. In a stationary member 23, FIG. 5, which is fixed to the keyboard chassis 1, there are provided bearing recesses 24 which are substantially equal to the maximum diameter of the shafts 22, narrow guiding slots 25 for guiding the shafts 22 from outside into the bearing recesses 24, and a split slot or groove 26 for inserting thereinto the hammer 8. These shafts 22 and bearing recesses 24 constitute a fulcrum 27, FIG. 6, into which the hammer 8 can be fitted. The hammer 8 is thus introduced through the guiding slots 25 into the bearing recesses 24 to thereby swingably support the hammer 8 on the stationary member 23. The width of the guiding slots 25 is formed substantially equal to the minimum width of the shafts 22. In the keyboard apparatus in general, lateral vibrations or clattering of the hammers is not favorable because the feeling of key-touching is impaired. Therefore, in the arrangement shown in FIG. 5, it is necessary to make the clearance between the internal surface 28 of the split groove 26 of the stationary member 23 and the side surface 29 of the hammer 8 which abuts them, to a small value over the wide entire area of the clearance. However, since the hammers 8 and the stationary members 23 are made by resin moulding, casting, or the like, the mechanical finishing of the metallic moulds must be made in a very precise manner in order to minimize the clearance. This will result in a higher cost for manufacturing or machining the metallic moulds. If the above-described area of abutment or contact is minimized, the cost for machining the metallic mould may be reduced. Then, the lateral clattering cannot sufficiently be prevented, and extra members for preventing the lateral clattering will have to be provided, resulting in an extra trouble. This kind of problem of preventing the lateral vibrations or clattering also arises in directly supporting the keys on the stationary members.

In order to prevent the keys from being damaged due to vibrations while the electronic musical instrument is transported, if the rear upper portion of the keys 31 is held or pressed by the rail 33 which moves up and down as shown in FIGS. 7 and 8, there is a disadvantage in that the distance of vertical movement of the rail 33 must be kept large with the result that the keyboard apparatus becomes large in construction. This system is not suitable for a keyboard apparatus in which the hammers are provided in the rear upper portion of the keys.

OBJECTS AND SUMMARY OF THE INVENTION

An object of the present invention is to solve disadvantages in a keyboard apparatus for an electronic musical instrument in that the dynamic feeling of key-touching varies between the black keys and the white keys and that the detected values from the detecting means for detecting touching of the hammers vary between the black keys and the white keys.

Another object is to provide an electronic musical instrument which is provided with an inexpensive and easily adjustable stopper member having an improved feeling of key-touching.

A still another object is to provide a keyboard apparatus which is small in weight, large in strength and inexpensive in manufacturing cost.

A still another object is to prevent lateral vibrations or clattering of the swinging members such as the hammers and the keys which are supported by fulcrums of insertable construction of the keyboard apparatus, by a construction which is simple and easy of manufacturing.

Another object is to prevent damages to the keyboard apparatus during transportation, by fixing the hammers and the keys together without an increase in the size of the keyboard apparatus.

A still another object is to provide an apparatus of fixing the hammers of the keyboard apparatus without complicating and enlarging the construction of the keyboard apparatus.

According to the present invention, the foregoing and other objects are attained by a keyboard apparatus for an electronic musical instrument comprising a metallic keyboard chassis; a balance rail provided on the keyboard chassis; a plurality of pins provided on the balance rail, the respective pins and the balance rail constituting fulcrums for swingably supporting white keys and black keys, the fulcrums for the black keys being disposed on a same line with, or in front of, the fulcrums for the white keys; and hammers which are provided in a rear of the keys so as to be swingable by swinging of the respective keys; wherein the hammers are disposed on a same axis of rotation; and a position for the black keys to operate to swing the respective hammers is located in front of a position for the white keys to operate to swing the respective hammers such that an angle of rotation of the respective hammers becomes substantially equal to each other.

The above-described keyboard apparatus preferably is provided with detecting means, disposed at a position of striking of the hammers, for detecting touching of the hammers.

In accordance with another aspect of the present invention, a keyboard apparatus for an electronic musical instrument comprises a keyboard chassis; a balance rail provided on the keyboard chassis; a plurality of pins provided on the balance rail, the respective pins and the balance rail constituting fulcrums for swingably supporting white keys and black keys; hammers which are provided so as to be swingable by swinging of the respective keys; a stopper member for restricting the swinging movement of the keys or the hammers. The stopper member is provided in a rear upper portion of the keys and comprises a rail which extends over the hammers in a direction in which the keys are arranged, and comb-like abutment pieces which extend from the rail in a longitudinal direction of each of the keys.

In accordance with another aspect of the present invention, a keyboard apparatus for an electronic musical instrument comprises a metallic keyboard chassis; a balance rail provided on the keyboard chassis; a plurality of pins provided on the balance rail, the respective pins and the balance rail constituting fulcrums for swingably supporting white keys and black keys; first restricting means, provided in a front portion of the keyboard chassis, for restricting downward swinging movement of the keys; second restricting means, provided in a rear portion of the keyboard chassis, for restricting upward swinging movement of the keys; wherein the keyboard chassis is divided into a front chassis portion provided with the first restricting means and a rear chassis portion provided with the second restricting means; and wherein the front chassis portion and the rear chassis portion are connected together by a plurality of metallic reinforcing beams which extend parallel with the keys.

In accordance with another aspect of the present invention, a keyboard apparatus for an electronic musical instrument comprises a metallic keyboard chassis; a balance rail provided on the keyboard chassis; a plurality of pins provided on the balance rail, the respective pins and the balance rail constituting first fulcrums for swingably supporting white keys and black keys; hammers which are respectively provided in a rear of the white keys and the black keys so as to be swingable by swinging of the keys; second fulcrums for swingably supporting swingable members such as the hammers or the like on stationary members. Each of the second fulcrums comprises a shaft which is oval in cross section and which is provided on each side surface of one of the respective swingable members and the respective stationary members; bearing recesses which are provided on the other of the respective swingable members and the respective stationary members and which have guiding slots for respectively guiding the shaft from outside into the bearing recesses; and a split groove which is provided in the other of the respective swingable members and the respective stationary members such that the one of the respective swingable members and the respective stationary members can enter; wherein there is formed around the shaft a first abutment surface which projects from the side surface; and there is formed a second abutment surface by reducing the width between each side surface; and wherein a surface for preventing lateral vibrations is formed on an internal surface of the split groove in close proximity to the second abutment surface.

In accordance with another aspect of the present invention, a keyboard apparatus for an electronic musical instrument comprises a keyboard chassis which is provided on a key bed; a plurality of white keys and black keys, each of the keys being swingably supported by a fulcrum on the keyboard chassis; hammers which are provided in a rear upper portion of the keys so as to be swingable by swinging of the keys; a rail which is provided in front of a swinging end of the keys and which extends in the lateral direction of the keys; a post for mounting thereon the rail such that the rail is movable between a first position in which the rail pushes upper surfaces of the hammers and a second position in which the rail is retreated from the upper surfaces; and a member for preventing the rail from flexing in the direction of movement thereof, the member being vertically movably provided through the key bed.

In accordance with another aspect of the present invention, a keyboard apparatus for an electronic musical instrument comprises a keyboard chassis which is provided on a key bed; white keys and black keys swingably supported by fulcrums on the chassis; hammers which are provided in a rear upper portion of the keys so as to be swingable by swinging of the respective keys; a stopper member provided in a rear upper portion of the keys for restricting an upward swinging movement of the keys; and an inflatable elongated air cushion means which is provided between the keys and the hammers to immovably hold the hammers when the air cushion means is inflated.

By locating the position for the black keys to operate to swing the respective hammers in front of the position for the white keys to operate to swing the respective hammers, the length of each black key from the fulcrum on the balance rail backwards becomes shorter. As a consequence, the distance for the black key to move the hammer upwards when the black key is swung, also becomes short. The swing angle of the hammer to be swung by the black key, therefore, becomes substantially equal to that of the hammer to be swung by the white key. As a result, the dynamic feeling of touching of the black key and of the white key can be made uniform. Further, since the hammer for the black key and the hammer for the white key move at substantially the same angle, substantially equal detected values can be obtained at the same depressing speeds of the black key and the white key, in case the detecting means for detecting touching of the hammers are provided in each of the hammers. When a key is depressed, the hammer in the rear of the key is swung upwards and its swinging movement is restricted by the hammer's abutting the comb-like abutment piece. When the feeling of key-touching is poor, it can be adjusted only by bending the abutment piece. Since the abutment piece is positioned above the hammers which lie above the keys, the adjustment can be easily performed with an upper cover of the musical instrument removed or opened. Further, since the abutment pieces can be made integrally with the rail, the manufacturing is easy and cheap.

The keyboard chassis is divided into the front chassis portion and the rear chassis portion which is provided with the second restricting means for restricting upward swinging movement of the keys. Preferably, the front chassis portion is provided with the necessary parts such as means for restricting the downward swinging movement of the keys, balance rail, sound generating switches and the like. The rear chassis portion is preferably provided, as explained above, with the necessary parts such as restricting means for restricting the upward swinging movement of the keys. The front chassis portion and the rear chassis portion are connected together by a plurality of metallic reinforcing beams. These metallic reinforcing beams extend in parallel with the keys to be mounted or assembled later. The front chassis portion, the rear chassis portion and the plurality of metallic reinforcing beams constitute a keyboard chassis of substantially frame shape. The keys and the hammers are thereafter placed in position into the keyboard apparatus. Depending on the specification of the musical instrument, the length of the keys may vary. In such a case the keyboard chassis can be assembled by changing the length of the metallic reinforcing beams. The assembled keyboard chassis is mounted on the key bed normally of wooden make. Since the keyboard chassis is substantially in the form of a frame with a large strength and small weight and high accuracy, the chassis itself and the key bed are not subject to deformation due to environmental changes, thereby bringing about a good feeling of playing the electronic musical instrument.

When each of the hammers in the form of the swingable member is swingably supported by the shafts of oval cross sectional shape and the bearing recesses having guiding slots, on the stationary member which is provided in the keyboard chassis or the like, there is formed a first abutment surface which projects from the side surface of one of the swingable member and the stationary member and a second abutment surface by reducing the width between the above-described each side surface to form a surface for preventing lateral vibrations or clattering on an internal surface of the split groove. Consequently, it is sufficient to form the swingable members and the stationary members by means of the metallic moulds whose abutment surfaces and the surfaces which contact them alone are precision-fabricated. The costs of the metallic moulds therefore become cheap. The freedom with which the fulcrum is fitted is not impaired and no particular members for preventing the lateral vibrations are required. The assembling and the replacement of the members can thus be carried out easily.

When the electronic musical instrument is transported, the post is moved towards the hammers while the member for preventing the rail from flexure is pulled down. The post is mounted integrally with the rail. With the movement of the post, the rail is therefore moved to the position in which the rail pushes the upper surfaces of the hammers. When the member for preventing the rail from flexing is returned, i.e., moved upwards, the rail is prevented from being displaced, through flexure of the rail, out of the position for pressing the hammers. By transporting and moving the electronic musical instrument under this condition, the hammers are pressed by the rail and will not be swung, thereby preventing the swinging of the keys which are associated with the hammers. The damages to the movable parts of the electronic musical instrument due to the vibrations during transportation can thus be prevented. After the transportation has been finished, the member for preventing the rail from flexing is pulled down and the post is returned to its original position. The rail is thus returned to its retracted position. Then, the member for preventing the rail from flexing is returned, i.e., moved upwards to fix the rail so that it does not move in the direction of its movement. The rail moves substantially in the longitudinal direction of the keys, the electronic musical instrument will not be enlarged due to the provision of this apparatus for fixing the hammers.

In an embodiment to provide an air cushion means between the hammers and the keys to fix the hammers, the air cushion is placed between the hammers and the keys without filling the air cushion means with air. Then, the air cushion is filled with an appropriate amount of air by means of a pump or the like. When the air cushion means has been inflated, the keys are held in an elevated position and the hammers are held abutted against the stopper which is positioned thereabove. Even if the electronic musical instrument is subjected to shocks during transportation, the air cushion means will absorb the shocks to be applied to the hammers. Therefore, there is no possibility of the damages to the hammers, and the swinging of the keys can also be prevented. When the transportation of the electronic musical instrument has been finished, the air cushion means is cut or the air filling port is opened to discharge the air inside the air cushion means, which is thereafter taken out from between the keys and the hammers to be ready for the playing.

BRIEF DESCRIPTION OF THE DRAWINGS

The above and other objects and the attendant advantages of the present invention will become readily apparent by reference to the following detailed description when considered in conjunction with the accompanied drawings wherein.

DETAILED DESCRIPTION OF THE INVENTION

Preferred embodiments of the present invention will now be explained with reference to FIGS. 9 through 24. In these figures, the same numerals as those of FIGS. 1 through 8 are used for the same members.

Figure 9:
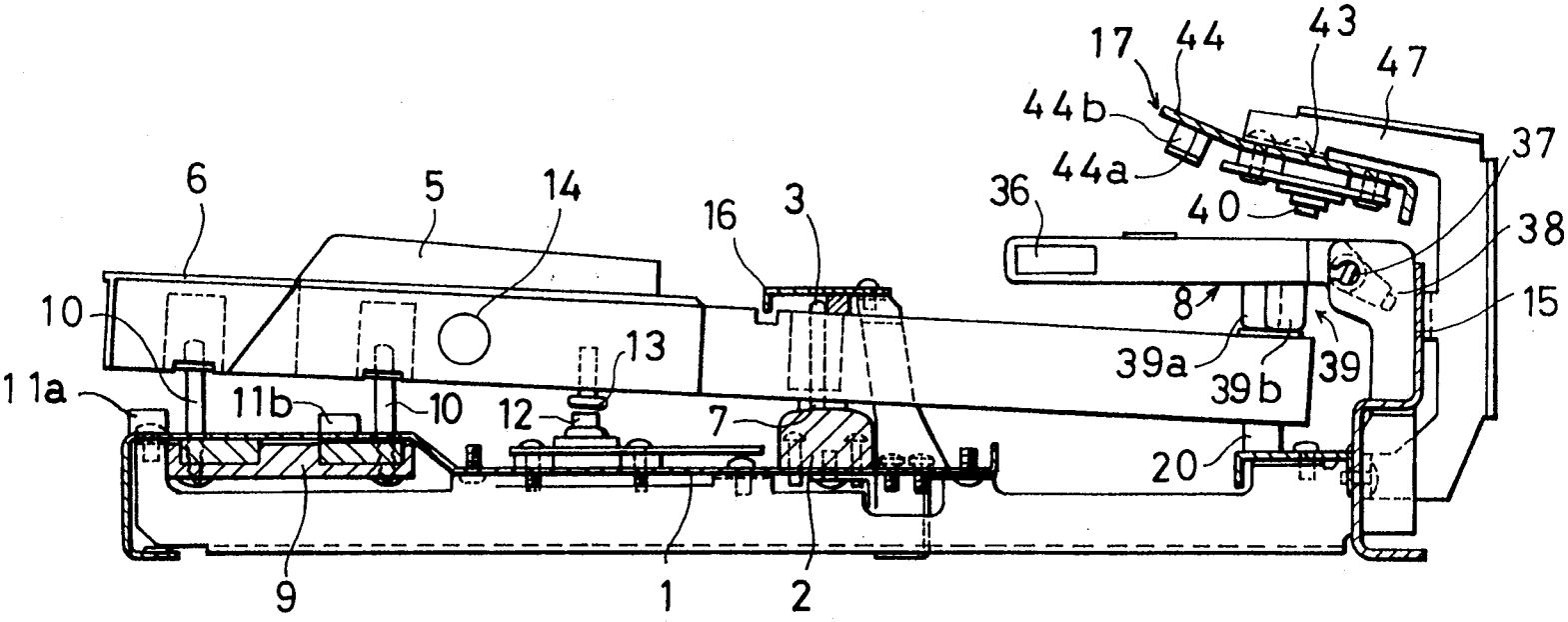
FIG. 9 is a cross-sectional view of a keyboard apparatus for an electronic musical instrument according to the present invention.
Figure 10:
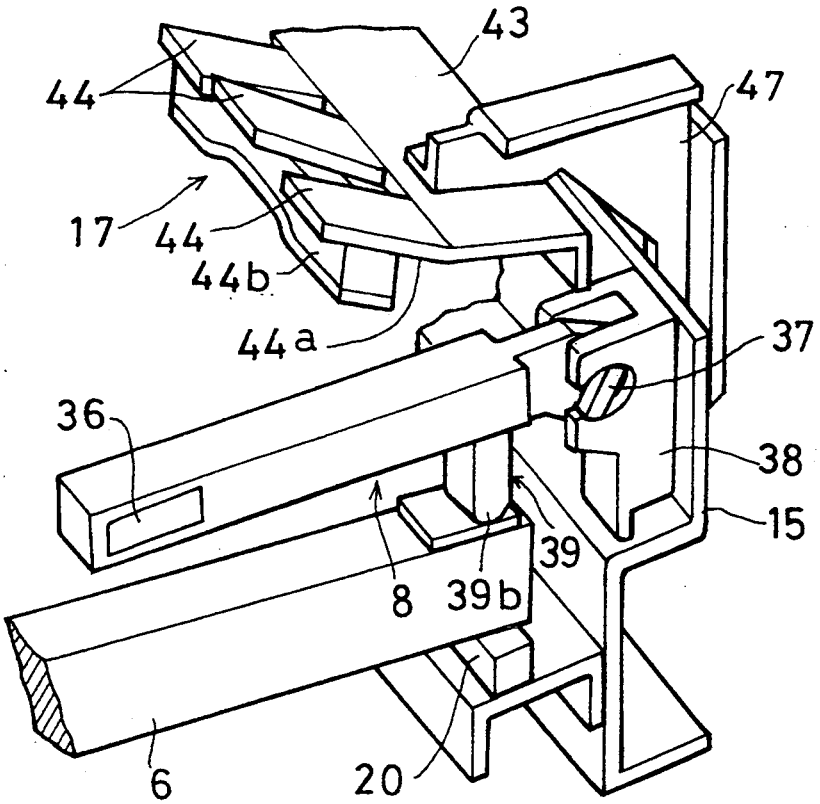
FIG. 10 is an enlarged perspective view showing an important portion of the apparatus of FIG. 9.
Figure 11:
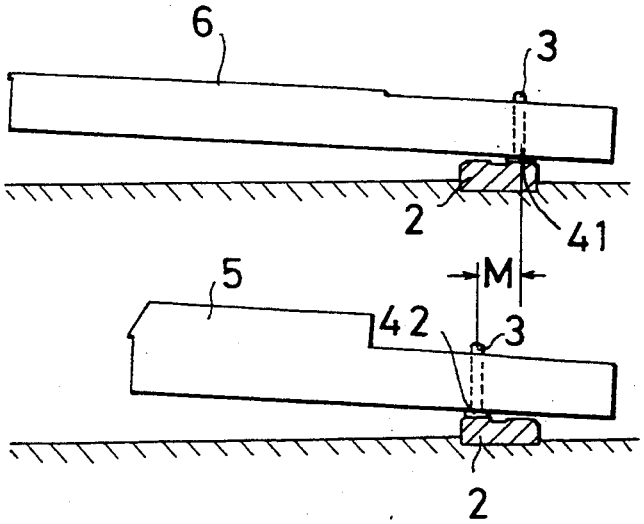
FIG. 11 is a schematic diagram explaining the operation of the keys according to the present invention.

Embodiments shown in FIGS. 9 through 11 are directed to the first embodiment of the invention. Numeral 1 denotes a metallic chassis of the keyboard musical instrument, numeral 5 denotes a wooden black key, and numeral 6 denotes a wooden white key on the front side of the black key 5, as viewed in FIG. 9. Keys 5, 6 are swingably supported on fulcrums 7. Each of the fulcrums 7 is made up of a balance rail 2 of a plastic material and provided on the metallic chassis 1, and a plurality of pins 3 which are arranged separately in a row in the direction to cross at right angles the longitudinal axis of each key (i.e., in a direction perpendicular to the plane of the drawing). Below each of these black keys 5 and white keys 6, there is, respectively, provided, a sound generating switch 12. When each of these keys 5, 6 is depressed downwards, a switch pressing member 13 provided in each key operates to press the sound generating switch 12. Through consequent operation of a sound generating circuit connected to the switch 12, a sound is generated. On the rear side (i.e., on a side away from a player) of each key 5, 6, there is provided a hammer 8, with a hammer weight 36, so as to be swingable about a rotatable shaft 37, and the rotatable shaft 37 of each of the hammers 8 is arranged in the same axial line. Details of one example of the supporting portion of the hammer 8 are as shown in FIG. 10. In such supporting portion, an upwardly extending supporting member or stationary member 15 is mounted on the metallic chassis 1, FIG. 9, and the rotatable shaft 37 is rotatably supported on a bearing member 38 provided on each member 15. In FIG. 9, numeral 11*a* denotes a restricting means for restricting the downward swinging movement of the white key 6 (i.e., lower limit stopper means) and numeral 11*b* denotes a restricting means for restricting the downward swinging movement of the black key 5 (i.e., lower limit stopper means). These means are respectively made up of a cushion material.

Figure 1:
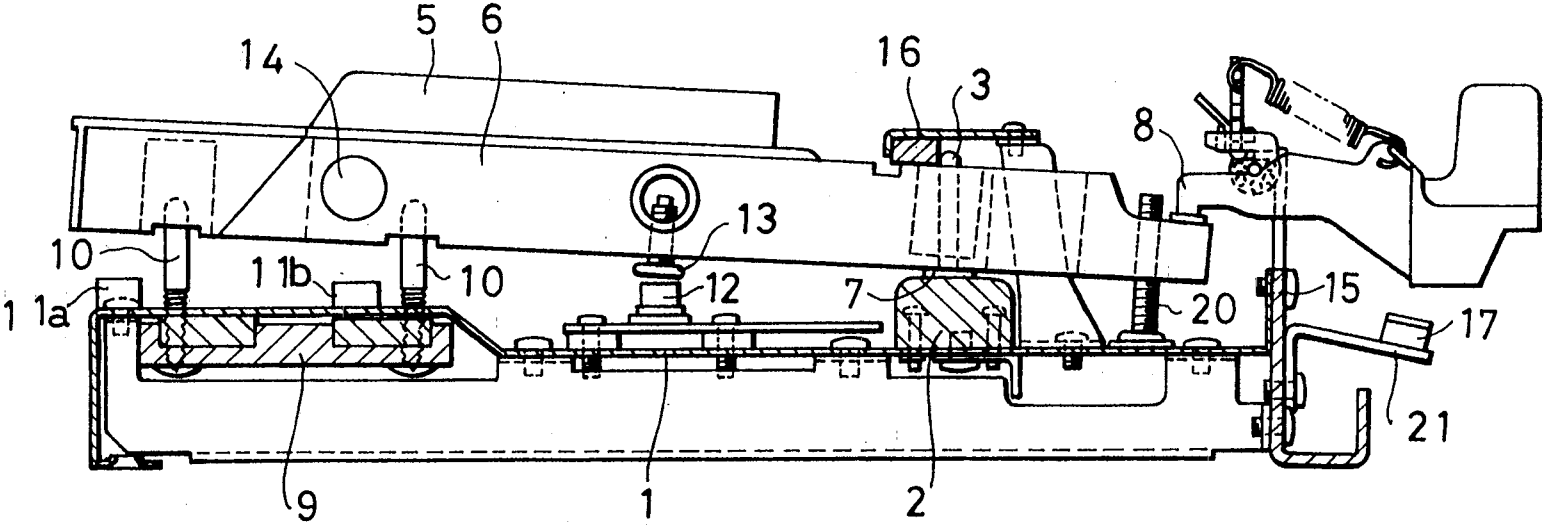
FIG. 1 PRIOR ART
FIG. 1 is a cross-sectional view of a conventional prior art keyboard apparatus for an electronic musical instrument.
Figure 2:
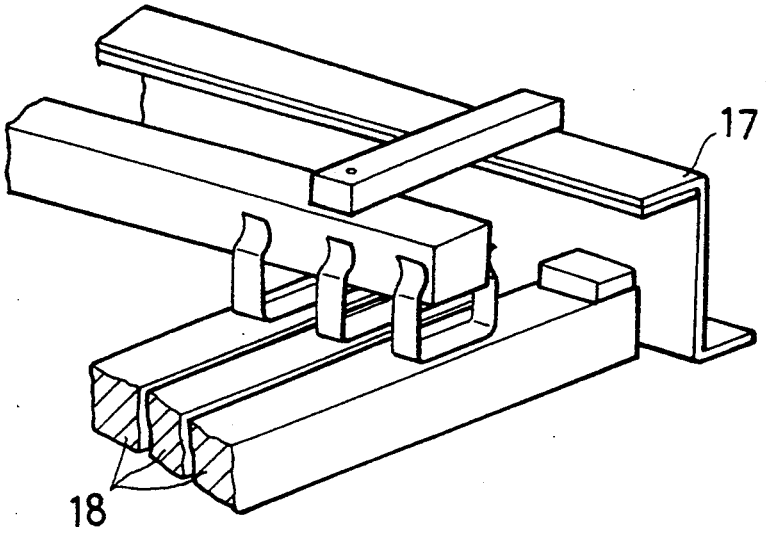
FIG. 2 PRIOR ART
FIG. 2 is a perspective view of a prior art apparatus restricting the keys of the conventional electronic musical instrument.
Figure 3:
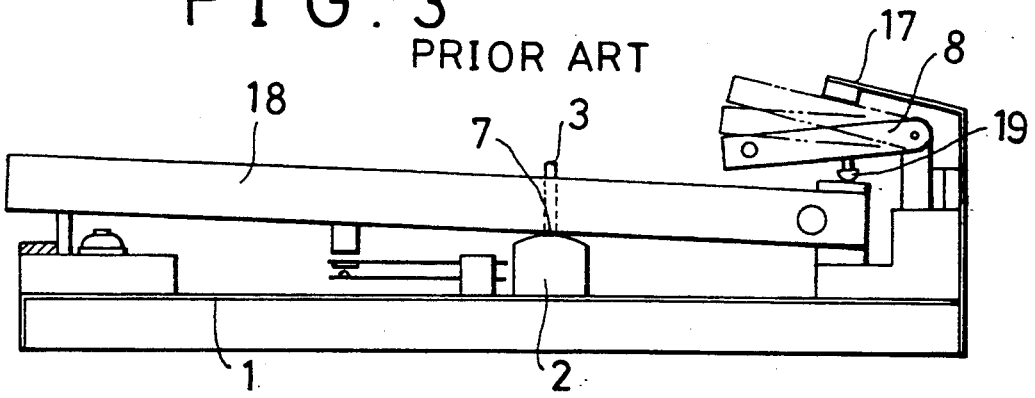
FIG. 3 PRIOR ART
FIG. 3 is a side view of another prior art apparatus for restricting the keys of the conventional electronic musical instrument.
Figure 4:
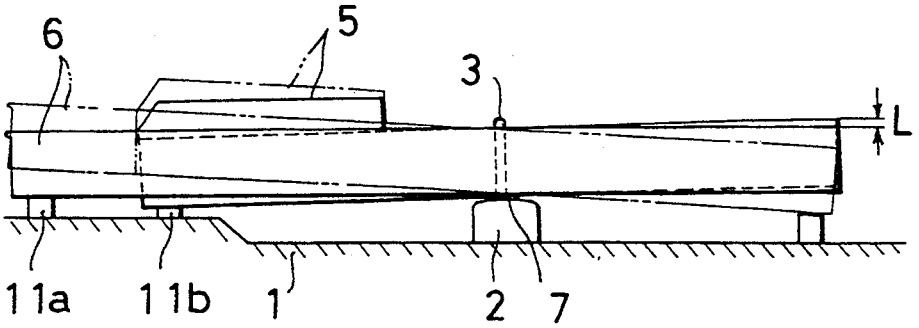
FIG. 4 PRIOR ART
FIG. 4 is an diagram showing the operation of the prior art keys.

The above-described arrangement is substantially equal to that of the conventional one. When the white key 6, for example, is depressed to operate the sound generating switch 12, the rear end portion of the key causes the hammer 8 to swing up and down. A force of inertia is thereby given to the key 6 and, as a consequence, the player can obtain a feeling as if he or she were playing an acoustic piano. The white key 6 and the black key 5 must be set so that they move up and down over the same distance in order to facilitate the playing. Therefore, as schematically illustrated in FIG. 4, the heights of the lower-limit stopper means 11*a*, 11*b* are set such that the black key 5 and the white key 6 travel up and down over the same distance. However, the black key 5 whose front length beyond the fulcrum 7 is shorter than the white key 6 has a larger angle of swinging than the white key 6 by an amount which is equivalent to the distance L, FIG. 4. Consequently, the hammer 8 is caused to swing more by that amount, hence the above-described disadvantage of different feeling of touching the key. Therefore, in one embodiment of the present invention, the position for the black key 5 to operate to swing the hammer 8 is located in front of the position for the white key 6 to operate to swing the hammer 8. In this manner, it is so arranged that each hammer is given substantially the same swinging angle. In the illustrated example, each hammer 8 is made to receive the function of force due to swinging of each key 5, 6 at a projection 39 which is provided in a projecting manner under each hammer 8. That projection 39*a* of the hammer 8 which cooperates with the black key 5 is disposed in front of that projection 39*b* of the hammer 8 which cooperates with the white key 6 so that the hammer 8 is not given a large swinging angle even if the black key 5 is swung by a large swinging angle. More specifically, the projection 39*a* is so disposed as to abut such an intermediate upper portion of the black key 5 as will correspond to the uppermost position in the rear portion of the white key 6.

In accordance with the above-described arrangement, each of the hammers 8 rotates at the same angle of rotation. As a consequence, the dynamic feeling of touching becomes uniform regardless of the white key or the black key. Also in an example in which detecting means 40 for detecting touching of the hammer are provided at portions where the hammers 8 come into contact, to control the sound generating circuit by means of the detected values, each of the hammers 8 is operated at the same angle. As a consequence, there will be no error in the values to be detected by the detecting means 40.

As shown in FIG. 11, it is also practiced to swingably support the black key 5 at a position at the front of the fulcrum 41 for the white key 6 by a distance M, by a fulcrum 42 which comprises a balance rail 2 and a pin 3 which is embedded into the balance rail 2. The present invention apparatus can also be applied to such an arrangement.

When the sound generating switch 12 is caused to be operated, the white key 6 and the black key 5 have different distances of movement at the rear end portions thereof as illustrated in the above-described FIG. 4. If these keys are restricted by the stopper 17 (rail) at the same position, there will be generated a difference in the feeling of touching the key between the white key 6 and the black key 5, resulting in a poor feeling of playing. Therefore, in another embodiment of the present invention, a metallic rail 43 is mounted on the stationary member 15 which projects upwards from the chassis 1 such that the rail 43 extends above the hammers 8 in the lateral direction, i.e., in the direction in which the keys 5, 6 are arranged. To one side of the rail 43 there are formed comb-like abutment pieces 44 which extend in the longitudinal direction of the keys. The hammer 8 is restricted by a stopper 17 which is made up of the rail 43 and the abutment pieces 44, thereby restricting the keys to the best extent possible. A cushion 44*b* may be provided across an abutment surface 44*a* of the abutment pieces 44, which are provided in the same number as the keys, such that the cushion 44*b* extends parallel to the rail 43.

In this manner, the difference in the feeling of touching due to the distance of operation at the rear end portions of the white key 5 and the black key 6 or the difference in the feeling of touching due to the deviations or fluctuations of the wooden keys in environmental changes, can be simply adjusted by adjusting the degree of bending of the comb-like abutting pieces 44 relative to the rail 43. Since this adjustment point lies above the keyboard apparatus, the adjustment work can be easily carried out.

Figure 12:
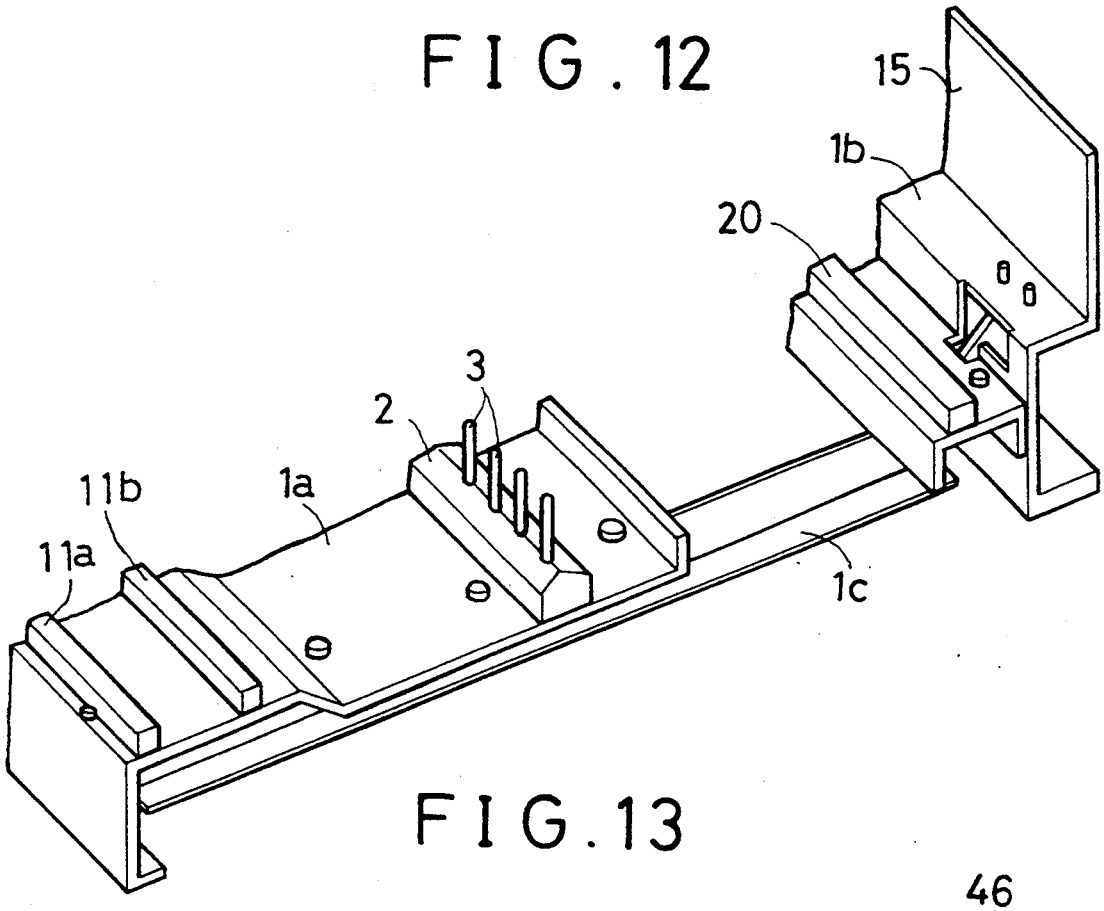
FIG. 12 is a perspective view of a keyboard chassis of the keyboard apparatus for the electronic musical instrument according to the present invention.
Figure 13:
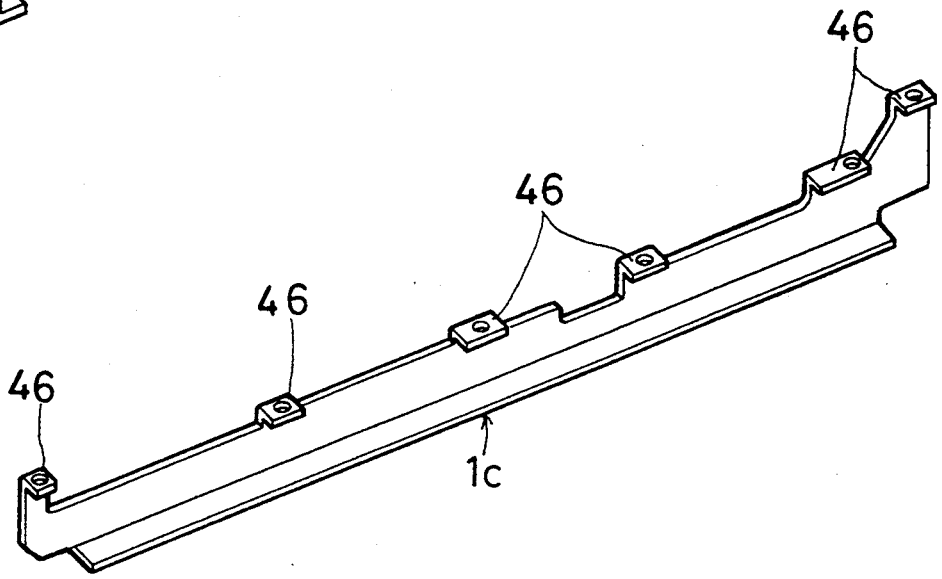
FIG. 13 is a perspective view of a metallic reinforcing beam of the keyboard chassis shown in FIG. 12.
Figure 14:
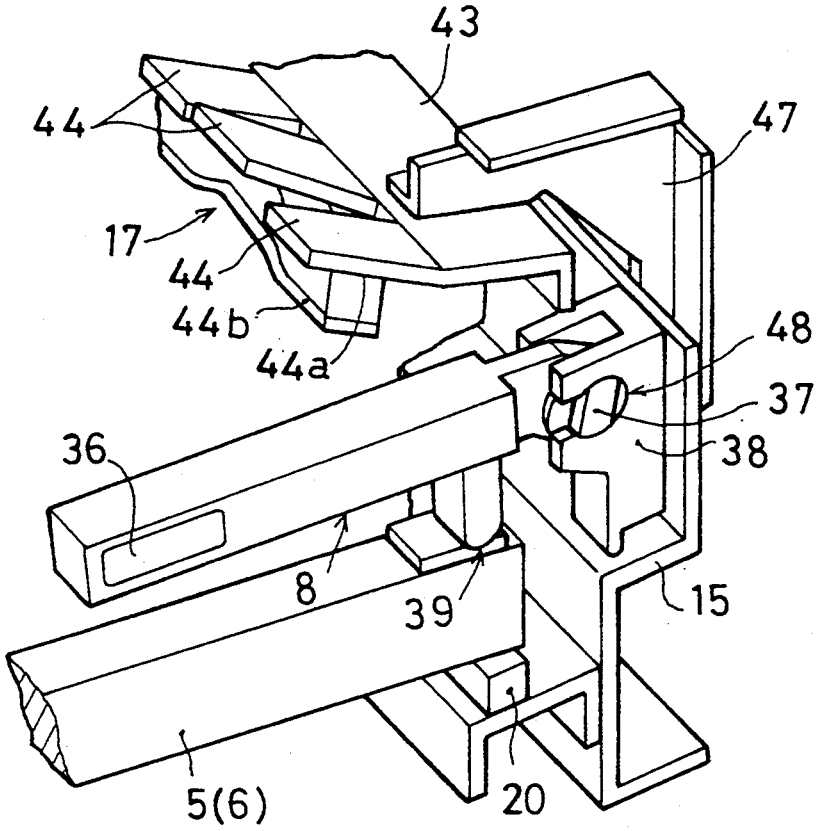
FIG. 14 is an enlarged perspective view of an important portion of the fulcrum apparatus according to the present invention.
Figure 15:
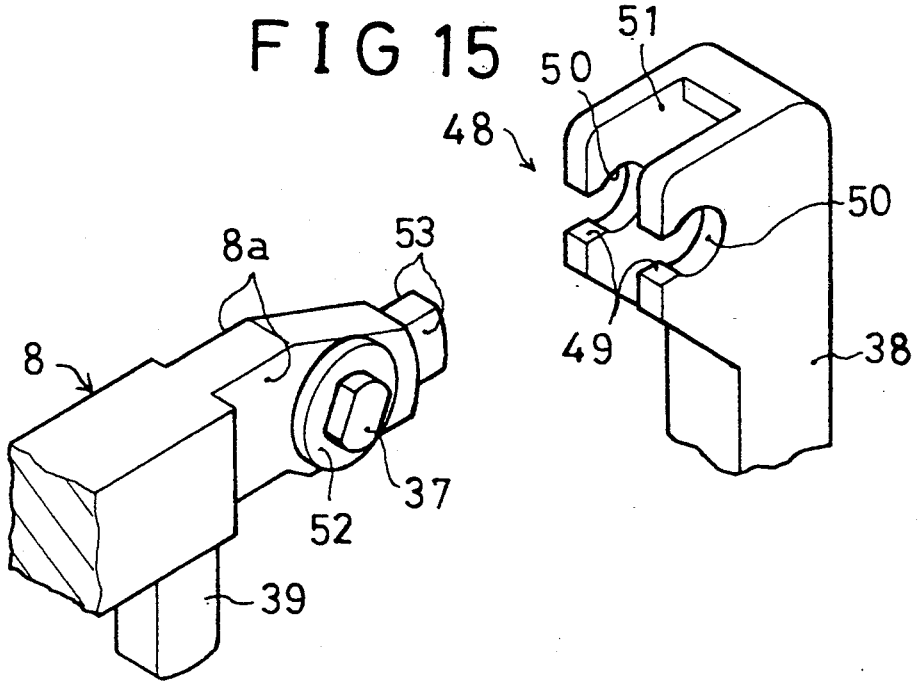
FIG. 15 is an exploded perspective view of the fulcrum of FIG. 14.

The embodiments shown in FIGS. 9, 12 and 13 are next described. Details of the keyboard chassis 1 shown in FIG. 9 are given in FIG. 12. The keyboard chassis 1 is made up of a front chassis portion 1*a*, rear chassis portion 1*b*, and a plurality of metallic reinforcing beams 1*c* which extend parallel to the keys 5, 6 and which connect chassis portions 1*a*, 1*b*. Although only one piece of metallic reinforcing beam 1*c* is shown in the figures, a plurality of pieces, e.g., 10 pieces, of beams 1*c* are actually disposed at an interval therebetween in order to connect the front chassis portion 1*a* and the rear chassis portion 1*b* both of which extend in the direction in which the keyboard is arranged. In this manner, they altogether constitute a keyboard chassis of enclosed frame shape. Details of each metallic reinforcing beam 1*c* are as shown in FIG. 13 which is L-shaped in cross section and is provided on its upper portion with fixing pieces 46 for inserting therethrough bolts for fixing purposes.

In the front chassis portion 1*a*, prior to its assembling into the keyboard chassis 1, there is provided two pieces of cushions 11*a* and 11*b* for the white keys and for the black keys, respectively, for restricting the downward swinging movement of the keys. Aside from cushions 11*a*, 11*b* there are also provided other necessary parts such as a balance rail 2 provided with pins 3, a front rail 9, FIG. 9, provided with guide pins 10, 10, sound generating switches 12, and the like. In the rear chassis portion 1*b* there is also provided one piece of cushion in advance as a means 20 for restricting the downward swinging movement of the keys. There are also provided other necessary parts such as bearing members 38 for supporting the hammers 8, which add a force of inertia to the keys 5, 6, a bracket 47 for mounting thereon the upper-limit stopper 17 for restricting the upward swinging movement of the hammers 8, and the like. The front and the rear chassis portions 1*a*, 1*b* which have mounted thereon the above-described necessary parts are connected together by the metallic reinforcing beams 1*c*. The keyboard apparatus is thus assembled and mounted on the key bed of the musical instrument.

Since the keyboard chassis 1 is made up of the front and the rear chassis portions 1*a*, 1*b* and a plurality of metallic reinforcing beams 1*c* into a frame shape, it is light in weight and stout. In case the lengths of the keys 5, 6 are changed, only the metallic reinforcing beams 1*c* may be changed in length and, therefore, the chassis portions 1*a*, 1*b* need not be changed.

Still further embodiments shown in FIGS. 14 through 17 which show details of the bearing members in the form of rotatable shafts 37, or shafts 37 about which the hammers are rotatable, as also shown in FIG. 9.

Each of the rotatable shafts 37 has a substantially oval cross section and is provided on both side surfaces 8*a* of the swingable member which comprises the hammer 8. These rotatable shafts 37 and a bearing member 38 which is integral with the stationary member 15 constitute a fulcrum 48. In the bearing member 38, there are provided bearing recesses 50, 50, having guiding slots 49, 49, as well as a split groove 51 for the hammer 8 of the swingable member to enter thereinto. The rotatable shafts 37 and the bearing recesses 50, 50 are made to constitute the fulcrum 48. The width of each guiding slot 49 is formed substantially equal to the minimum diameter of the shaft 37, and the diameter of each bearing recess 50 is formed substantially equal to the maximum diameter of the shaft 37.

Figure 16:
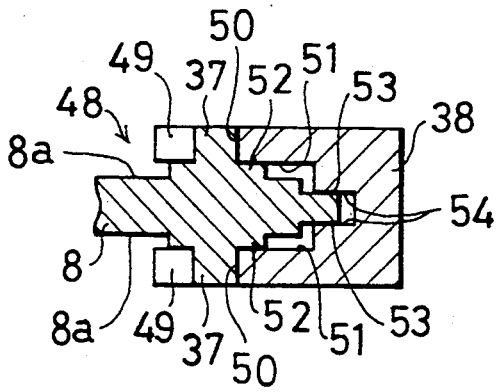
FIG. 16 is a cross-sectional plan view of the fulcrum portion of FIG. 14.
Figure 17:
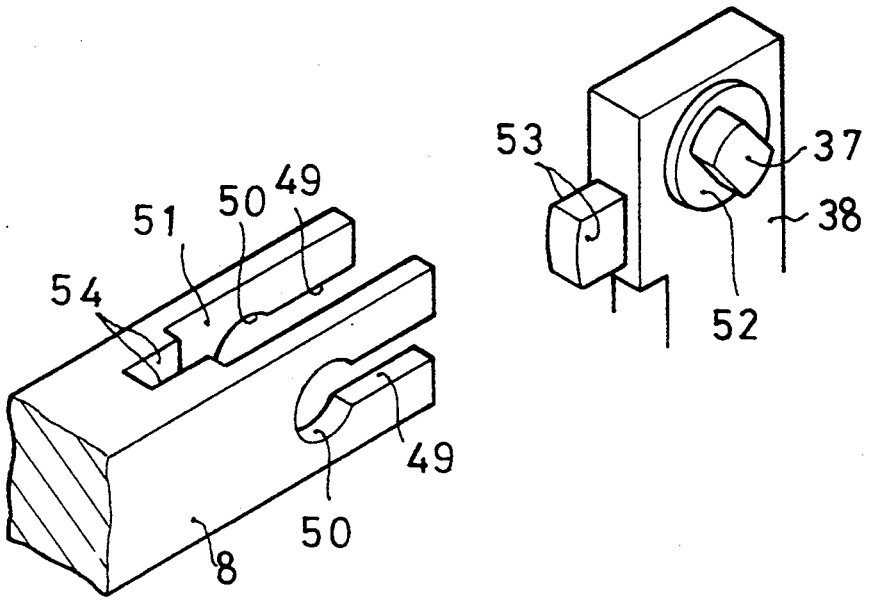
FIG. 17 is an exploded perspective view of another embodiment of the fulcrum of FIG. 14.

In the periphery of each rotatable shaft 37 of the swingable member (hammer) 8, there is formed a first circular abutment surface 52 which projects out of the side surface 8*a* of the swingable member 8. At the rear end of the swingable member 8, there are formed second abutment surfaces 53, 53 by reducing the width between both side surfaces 8*a*, 8*a* of the swingable member 8. As best shown in FIGS. 16 and 17, on an internal surface of the split groove 51 of the stationary member 38, there are formed surfaces 54, 54 for preventing the lateral vibrations or clattering and are in close proximity to the second abutment surfaces 53, 53. These swingable member 8 and bearing member 38 must be prepared in the same number as the keys 5, 6. Metallic molds are used for their manufacturing. Precision finishing of the molds may be applied only to those portions of the molds which correspond to the first and second abutment surfaces 52, 53 of the swingable member 8 and those portions of the molds which correspond to the first and second abutment surfaces 52, 53 of the bearing member 38. Therefore, the fabrication of the metallic molds becomes simpler and cheaper.

Figure 5:
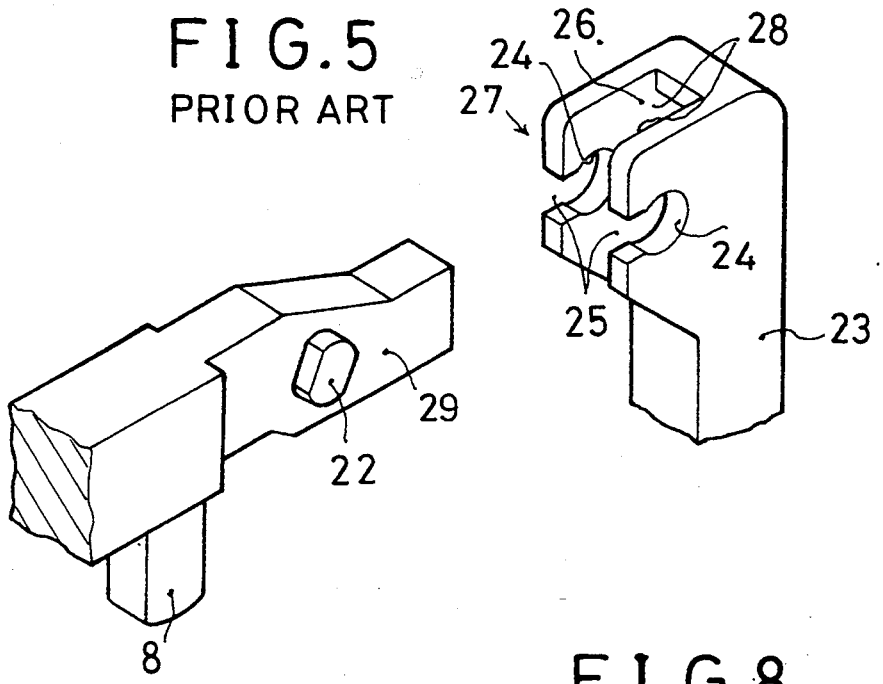
FIG.5 PRIOR ART
FIG. 5 is an exploded perspective view showing the construction of a previously proposed prior art fulcrum.
Figure 8:
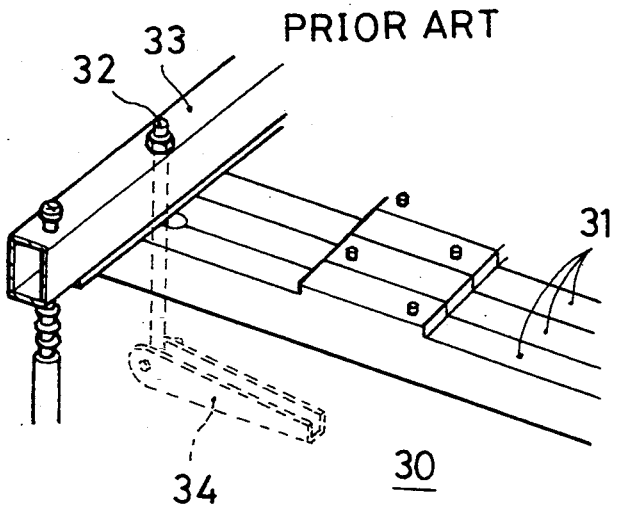
FIG.8 PRIOR ART
FIG. 8 is an enlarged perspective view of an important portion of FIG. 7.
Figure 6:
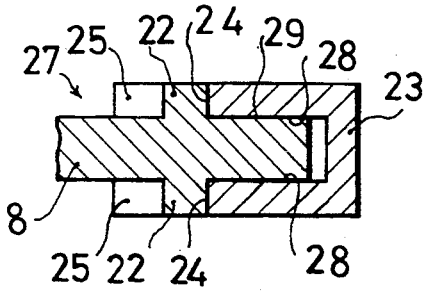
FIG.6 PRIOR ART
FIG. 6 is a cross-sectional view showing the assembled condition of the fulcrum of FIG. 5.
Figure 7:
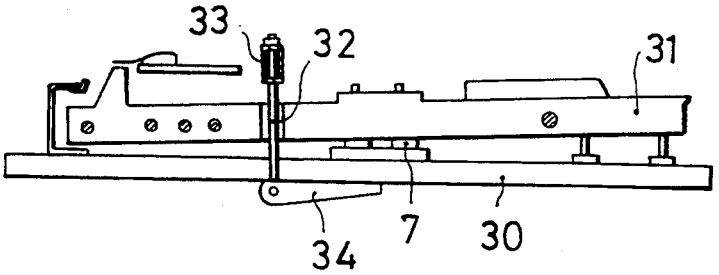
FIG.7 PRIOR ART
FIG. 7 is a side view of a prior art apparatus for fixing the hammers of the conventional electronic musical instrument.

The method of mounting the swingable member 8 to the bearing member 38 is the same as the one shown in FIG. 5. Namely, the swingable member 8 is introduced into the guiding slots 49 while inclining the swingable member 8 so as to fit the minimum diameter of the shafts 37 to the guiding slots 49 of the bearing member 38. When the shafts 37 have reached the bearing recesses 50, 50, the inclination is returned, thereby fitting the two members together.

FIG. 17 shows an example in which the guiding slots 49, 49, bearing recesses 50, 50 and the split groove 51 are formed in the swingable member 8 and in which the shafts 37, 37 are provided in the bearing member 38. These example is the same as the above-described one in that the first and the second abutment surfaces 52, 53 are formed in the member 8 having the split groove 51, and that the faces 54 for preventing the lateral vibrations or clattering are formed in the member 8 having the split groove 51. The swingable member 8 may be other members than the hammer.

Figure 18:
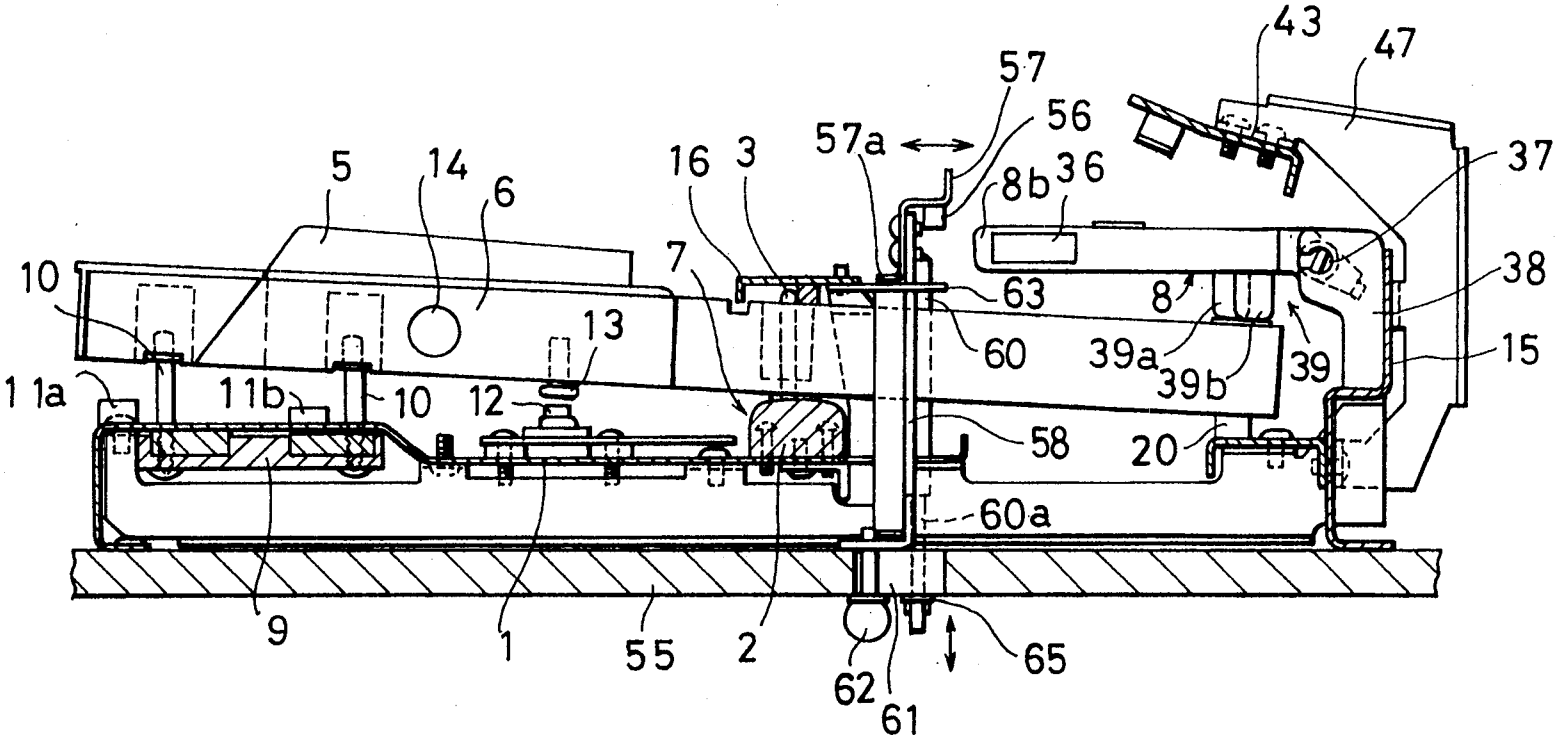
FIG. 18 is a partly sectional side view of a keyboard apparatus provided with a hammer fixing apparatus according to the present invention.
Figure 19:
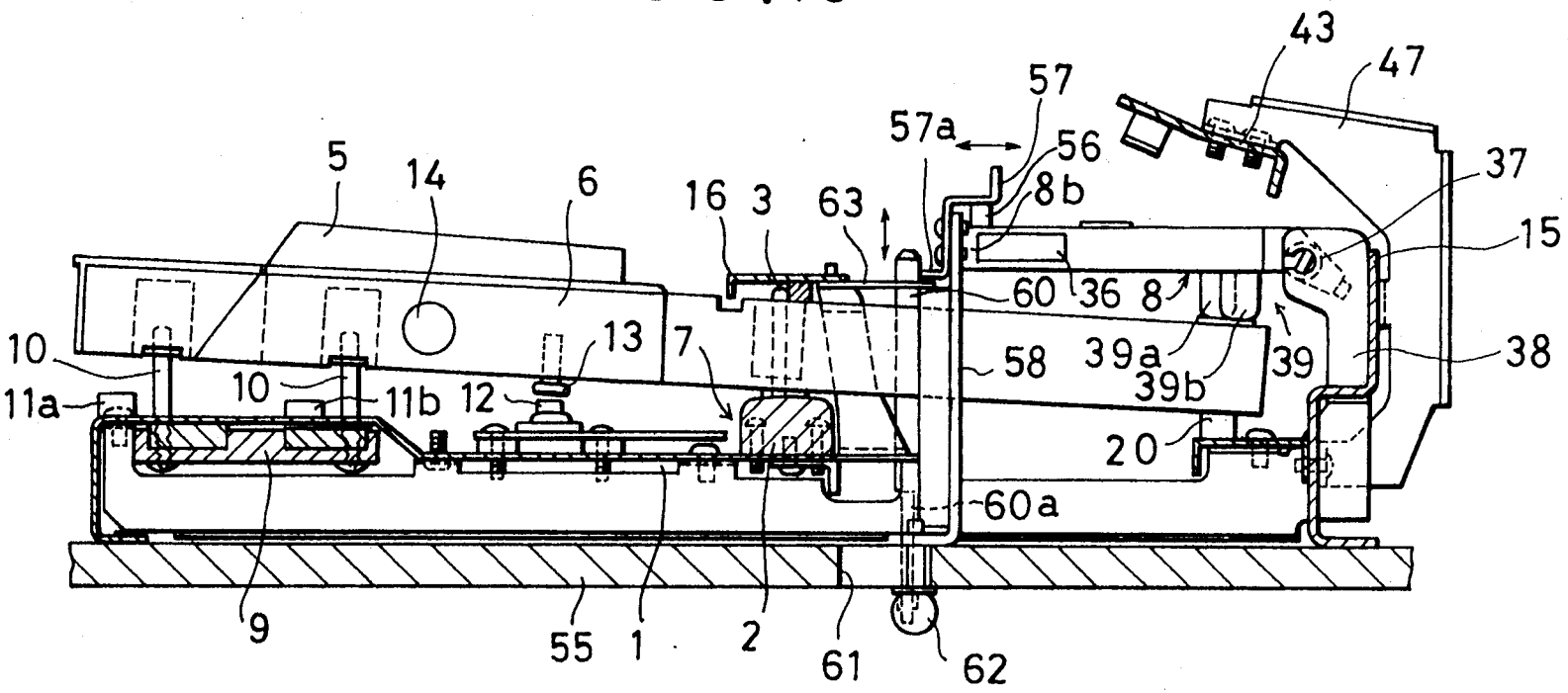
FIG. 19 is a sectional side view showing an operating condition of FIG. 18.
Figure 20:
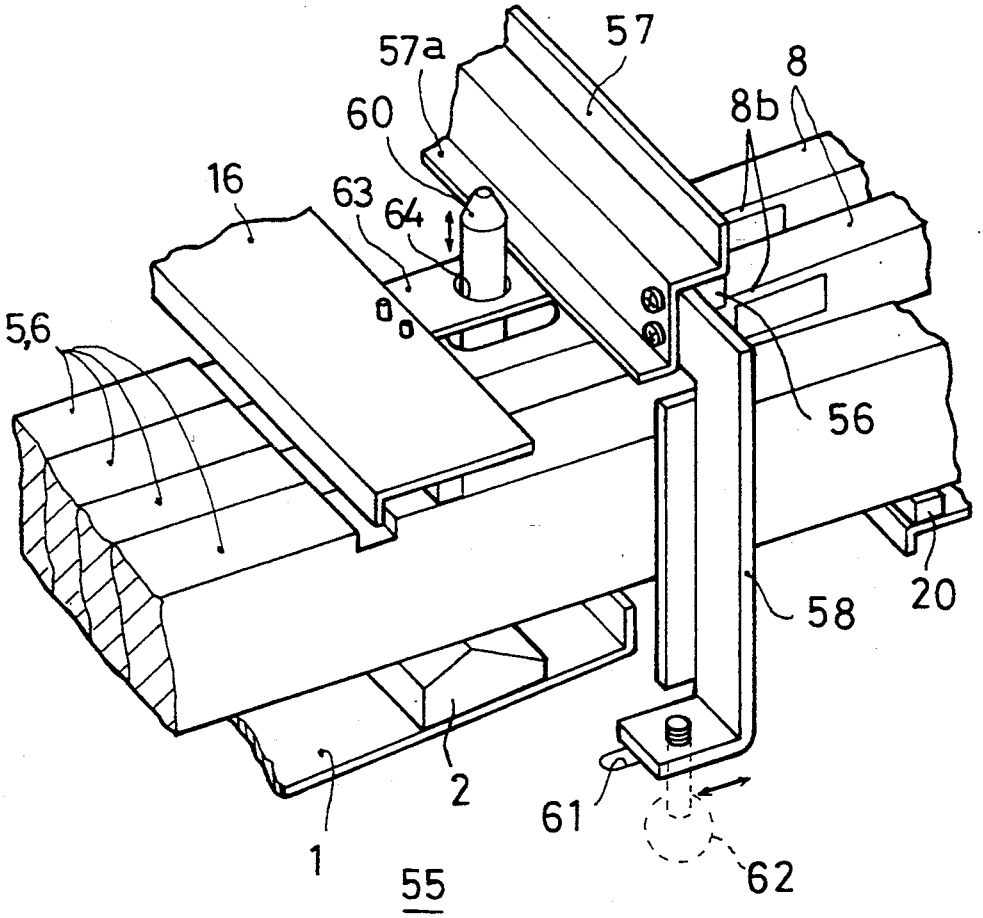
FIG. 20 is an enlarged perspective view of an important portion of the apparatus of FIG. 18.

Embodiments shown in FIGS. 18 through 24 are those which are covered by claims 9 through 12. In these embodiments, the metallic keyboard chassis 1 of the electronic musical instrument is fixed on the key bed 55. In order to provide a cushion 56 to restrict the upward movement of the hammers 8, there is provided above the keys a rail 57 which extends in the direction in which the keys are arranged. When the electronic musical instrument is transported, the hammers 8 may unnecessarily be swung by the vibrations due to the transportation and, consequently, the keys 5, 6 may also be swung, resulting in their damages. According to the present invention, however, there are provided a plurality of posts 58 which are movable back and forth in the longitudinal direction of the keys 5, 6. The rail 57 which extends in the direction to cross the keys 5, 6 is mounted on the posts 58, in front of the swinging end portion 8*b* of the hammers 8. This rail 57 is thus so arranged that it is movable back and forth between the retracted position as shown in FIG. 18 and the restricting or holding position as shown in FIG. 19. A member 60 for preventing the rail 57 from flexing or deflecting in the direction of its movement is vertically movably provided through the key bed 55, so that the hammers and the keys are prevented from damaging during transportation or the like of the electronic musical instrument.

In more detail, the key bed 55 is provided with a slot 61 which is elongated in the longitudinal direction of the keys 5, 6. An operating element 62 is extended from the bottom portion of the posts 58 to the outside of the bed plate 55 through the slot 61 so that the back and forth movement of the posts 58 can be done by the operating element 62. The member 60 for preventing the rail from flexing is formed with a reduced dimension at its lower half 60*a* to form a notched portion for limiting its downward movement. Its front end is arranged to be guided through an opening 64 in a guide plate 63 which is provided in the rail 57. Numeral 65 denotes an engaging piece to fix the member 60 for preventing the rail from flexing at an upper and a lower position, respectively. The lower end of the rail 57 is provided with a restricting piece 57*a* which is formed by bending the lower end to a width corresponding to the distance of forward and backward movement of the rail 57. The member 60 for preventing the rail from flexing is caused to abut the end of the restricting piece 57*a*, thereby preventing the flexure of the rail.

The above-described rail 57 is normally positioned in the retreated position in a non-flexing condition by the member 60 for preventing the rail 57 from flexing. When the electronic musical instrument is transported, the member 60 is pulled down and the posts 58 are advanced by the operating element 62 towards the hammers 8 to move the rail 57 to the position in which the swinging ends of the hammers are held or pushed down. The member 60 for preventing the rail from flexing is pulled up to set the rail 57 in the position so as not to flex. By this arrangement, the hammers 8 are not subject to swinging due to the vibrations during transportation of the musical instrument, thus preventing the damages to the hammers 8 and the keys 5, 6. After the transportation of the musical instrument has been finished, the member 60 is pulled down, the posts 58 are retreated, and the member 60 is pulled up to return the rail 57 to the original retreated position, thereby placing the musical instrument to a condition ready for playing.

Figure 21:
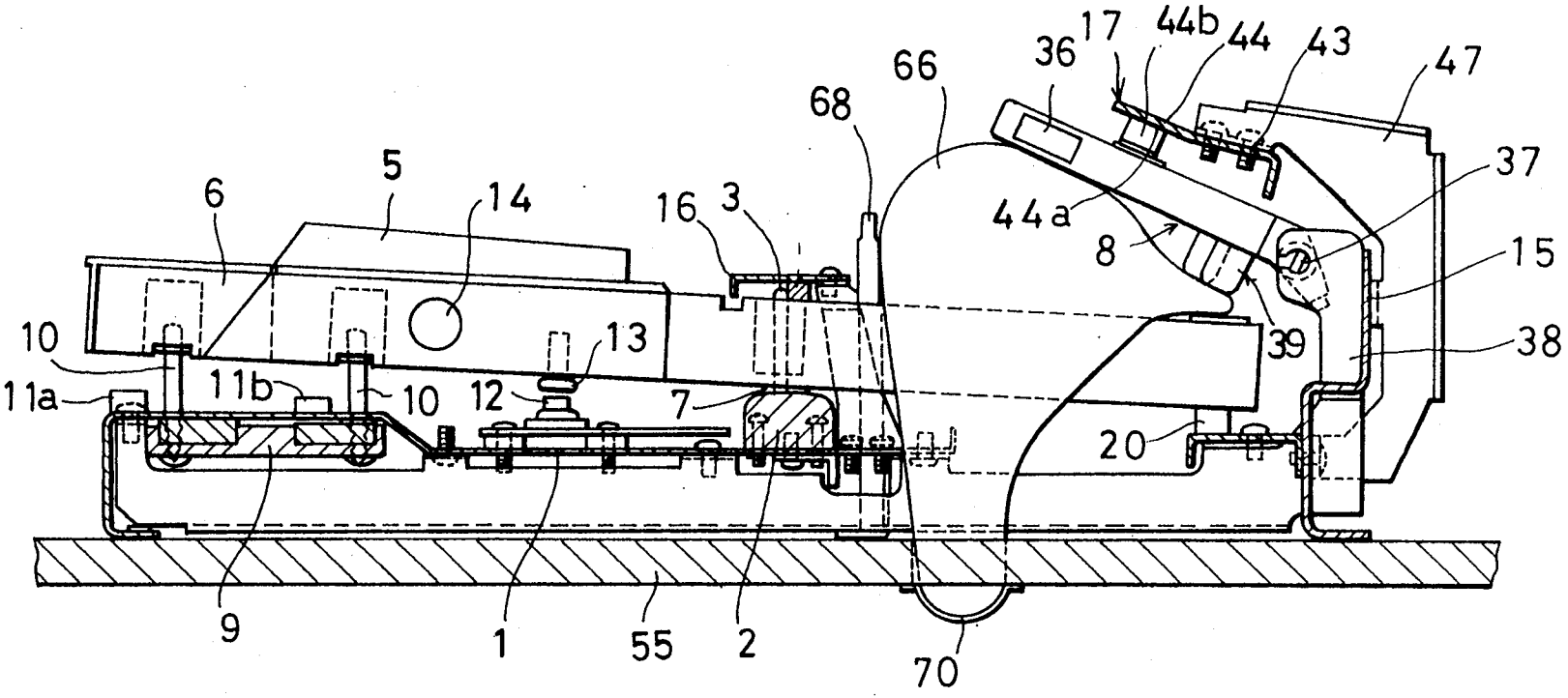
FIG. 21 is a sectional side view of another embodiment of the hammer fixing apparatus according to the present invention.

In the embodiment illustrated in FIG. 21, there is shown a means to prevent the hammers 8 and the keys 5, 6 from being damaged due to the vibrations during the transportation of the musical instrument. In particular, an elongated air cushion 66 is provided between the keys 5, 6 and the hammers 8 to urge the hammers 8 against the stopper 17 which is positioned thereabove, thereby preventing vibrations of the keys 5, 6 during transportation.

Figure 22:
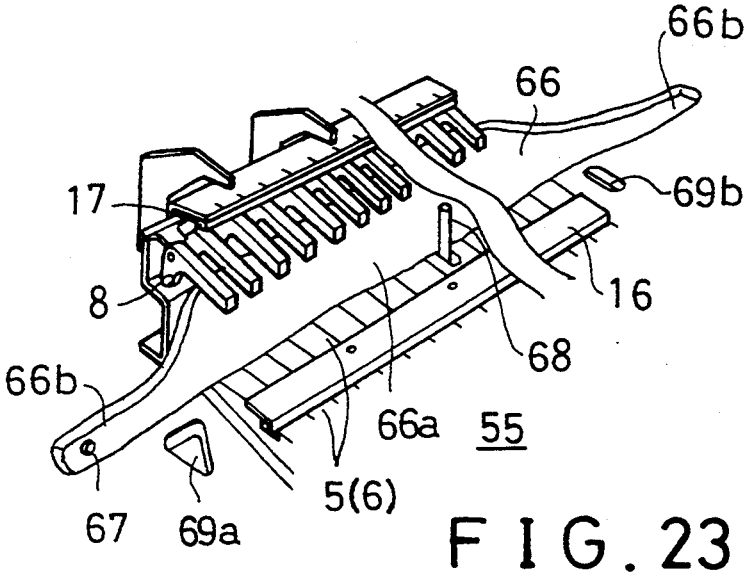
FIG. 22 is a general perspective view of FIG. 21.
Figure 23:
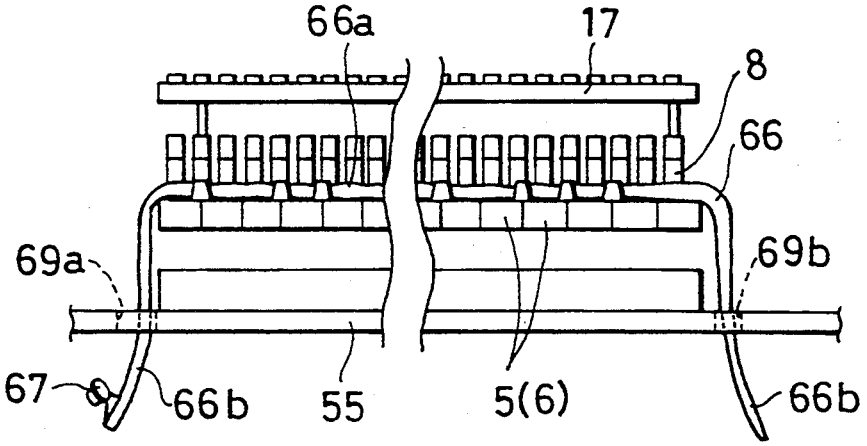
FIG. 23 is a sectional side view showing the operating conditions of FIG. 21.
Figure 24:
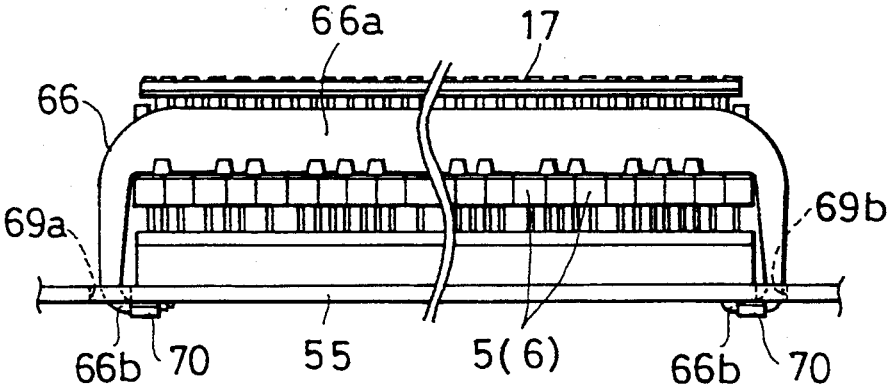
FIG. 24 is a sectional side view showing the operating conditions of FIG. 21.

As shown in FIG. 22, the air cushion 66 comprises that operating portion 66a to act on the stopper which has a length sufficient to extend over the entire length of the arranged keys 5, 6, and extension portions 66*b*, 66*b* which extend from both ends of the operating portion 66*a*. One 66*b* of the extension portions is provided with an air filling port 67 and the other 66*b* of the extension portions is kept closed. At the rear of the holder 16 for the keys there is provided a guide bar 68 which stands vertically from the key bed 55. This guide bar 68 operates to prevent the air cushion 66 which is disposed therebehind from moving forwards. The key bed 55 is provided, at right and left portions of the keyboard chassis 1, with perforations 69*a*, 69*b*. Both extension portions 66*b* of the air cushion 66 are inserted therethrough and fixed. One 69*a* of the perforations is formed in the form of an inverted triangle so that the air filling port 67 can pass through.

The air cushion 66 is tentatively disposed between the keys 5, 6 and the hammers 8 in a condition not filled with air. Then, by filling the air cushion 66 with air through the air filling port 67, the hammers 8 are caused to be urged against the stopper 17 which lies thereabove. The force of urging can be adjusted by the amount of air filled into the air cushion 66. In the example shown in FIG. 23, each of the extension portions 66*b* is inserted in advance through the perforations 69*a*, 69*b* and is fixed to the key bed 55 with an adhesive tape 70. However, these extension portions 66*b* may also be fixed to the key bed 55 after filling the air cushion 66 with air.

When the electronic musical instrument is transported, the air cushion 66 is placed between the keys 5, 6 and the hammers 8 before the air cushion 66 is filled with air. The air cushion 66 is then filled with air, and both extension portions 66*b*, 66*b* are fixed to the key bed 55. After the electronic musical instrument has been transported, that side of the extension portion 66*b* which is not provided with the air filling port 67 is cut off by a means such as a pair of scissors to expel the air inside the air cushion 66. By pulling the other side of the extension portion 66*b* to withdraw the contracted air cushion 66 out of position, the musical instrument is in a condition ready for playing.

It is readily apparent that the above-described keyboard apparatus for an electronic musical instrument meets all of the objects and also has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What is claimed is:

1. A keyboard apparatus for an electronic musical instrument comprising:

a metallic keyboard chassis;

a balance rail provided on said keyboard chassis;

a plurality of pins provided on said balance rail, said respective pins and said balance rail constituting fulcrums for swingably supporting white keys and black keys, said fulcrums for said black keys being disposed on a same line with, or in front of, said fulcrums for said white keys; and hammers which are provided in a rear of said white and said black keys so as to be swingable by swinging of said respective white and black keys; wherein said hammers are disposed on a same axis of rotation; and a position for said black keys to operate to swing said respective hammers of said black keys is located in front of a position for said white keys to operate to swing said respective hammers of each white key such that an angle of rotation of said respective white and black key hammers are substantially equal to each other.

2. A keyboard apparatus for an electronic musical instrument according to claim 1, further comprising detecting means, disposed at a position of striking of said white and black key hammers, for detecting touching of said hammers on said detecting means.

* * * * *